United States Patent [19]

Harjunpää

[11] Patent Number: 4,958,490

[45] Date of Patent: Sep. 25, 1990

[54] METHOD FOR REDUCING NITRIC OXIDE EMISSIONS IN EXHAUST GASES FROM DIESEL ENGINES

[75] Inventor: Harri J. Harjunpää, Outokumpu, Finland

[73] Assignee: Outokumpu Oy, Helsinki, Finland

[21] Appl. No.: 393,125

[22] Filed: Aug. 14, 1989

Related U.S. Application Data

[63] Continuation of Ser. No. 129,451, Dec. 7, 1987, abandoned.

[51] Int. Cl.[5] ..... F02M 25/06

[52] U.S. Cl. ..... 60/274; 60/278; 123/568; 123/570

[58] Field of Search ..... 60/274, 278; 123/568, 123/570, 569

[56] References Cited

U.S. PATENT DOCUMENTS

| | | | |
|---|---|---|---|
| 2,737,936 | 3/1956 | Clarke | 123/570 |
| 3,139,873 | 7/1964 | Gardner | 123/570 |
| 3,615,074 | 10/1971 | Cook | 60/278 |
| 4,075,994 | 2/1978 | Mayer | 60/278 |
| 4,181,110 | 1/1980 | Kohama | 123/568 |
| 4,340,013 | 7/1982 | Lindstrom | 123/568 |

*Primary Examiner*—Douglas Hart

*Attorney, Agent, or Firm*—Brooks Haidt Haffner & Delahunty

[57] ABSTRACT

A method for reducing the nitric oxide emissions of the exhaust gases from a diesel engine by means of a controlled recirculation of the exhaust gases, which are cooled off and humidified in a water bath. The exhaust gases created in the diesel engine (1) are conducted into the wet cleaner (3), and part of the exhaust gases conducted into the wet cleaner (3) are returned to the suction duct (10) of the diesel engine, so that the amount of the recirculated exhaust gas is maintained constant with respect to the total exhaust gas volume.

3 Claims, 2 Drawing Sheets

METHOD FOR REDUCING NITRIC OXIDE EMISSIONS IN EXHAUST GASES FROM DIESEL ENGINES

Figure 1:
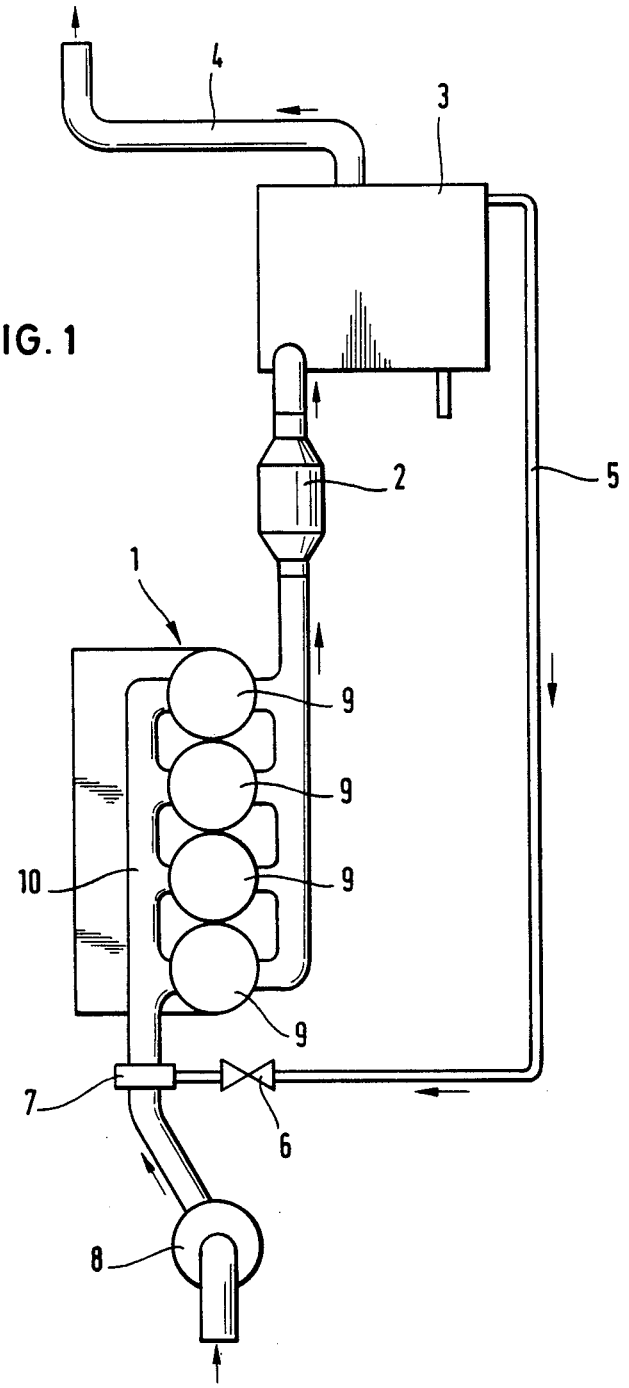

This application is a continuation, of application Ser. No. 07/129,451, filed Dec. 7, 1987, now abandoned.

The present invention relates to a method for reducing nitric oxide emissions in the exhaust gases from diesel engines by means of conducting water into the engine and by recirculating the exhaust gases.

A drawback in the use of combustion engines such as diesel engines arises in the form of harmful compounds contained in exhaust gases. Among them, the most dangerous and the most difficult to eliminate are nitric oxides. The amount of created nitric oxides is comparable to the temperature prevailing in the combustion chamber, as well as to the oxygen content of the explosion gas.

A previously known method for reducing the amount of nitric oxides is to lower the combustion temperature by adding water into the combustion chamber of the diesel engine. The water addition can be carried out in various ways: according to the DE Patent Applicatin No. 31 44 472, water is sprayed separately into the combustion chamber. In connection to the water addition, the water condensed from the exhaust gases can also be utilized; this water is conducted into the combustion chamber by means of spraying, as is the case with water additions in the apparatus introduced in the DE Patent Application No. 28 51 232. The supplied water is fed directly into the suction duct (DE Patent Application No. 28 31 694), or the water is first dispersed in a finer form by feeding the fresh combustion air through a liquid volume and further into the suction duct (DE Patent Application Nos. 26 01 456 and 26 33 639). The water to be conducted into the combustion chamber can also be first evaporated by means of a thermal exchanger, so that the heating is carried out by conducting the hot exhaust gases through a water container. The resulting steam is then conducted into the suction duct, whereas the exhaust gases are discharged into the open air. The evaporation method is introduced for instance in the SE Patent Publication No. 428 587 and DE Patent Application Nos. 21 54 755 and 26 04 050.

The drawback in the aforementioned methods for feeding water into the combustion chamber is the fact that the purchase expenses of the equipment needed for adjusting the water supply are very high. Moreover, its maintenance requires special care, which partly also increases the operational costs.

Another prior art method for diminishing the nitric oxide emissions of a diesel engine is partial recirculation of the exhaust gases. In certain prior art methods, for instance in those introduced in the SE Patent Publication No. 404 068 and DE Patent Application No. 2 443 897, the exhaust gas is recurculated back into the engine in dry form. The recirculated exhaust gas, the quantity whereof is advantageously 20% of the suction air volume, functions as an inert gas and thus reduces the oxygen content of the gas contained in the combustion chamber. Simultaneously the production of nitric oxide is also diminished. However, the regulation of recirculated exhaust gases is also difficult to control. Moreover, it is preferable that the recirculated exhaust gases are cooled off for instance in order to reduce thermal strain.

The method of recirculating damp exhaust gases is utilized in the fuel evaporator according to the U.S. Pat. No. 2,430,852. In that case, however, the recirculated damp exhaust gases are fed, together with the gasified fuel, into the suction space of a combustion engine. Consequently, the suggested arrangement cannot be applied for instance for diesel engines, where the fuel is sprayed into the combustion chamber.

In an apparatus according to the DE Patent Application No. 2 504 308, a part of exhaust gases is conducted to the wet cleaner wherefrom the washed and cooled exhaust gases are recirculated. The amount of these exhaust gases recirculated according the DE Application is in no iway maintained constant and this recircualtion is not utilized, either, when the motor is operating with idling or with full load. Further, a safety valve is required in the apparatus of the DE Patent Application 2 504 308 and in that apparatus distilled water is used and the delivery of that kind of water is in many cases difficult.

The object of the present invention is to eliminate some of the drawbacks of the prior art and to realize an improved, more secure method for reducing the nitric oxide emissions of diesel engine exhaust gases, by means of applying the recirculation of cooled exhaust gases combined to the aqueous vapours resulting from the wet cleaning of the exhaust gases.

According to the invention, the exhaust gases from the engine are conducted through a catalyzer, advantageously for reducing the amount of carbon monoxide and hydrocarbons, before directing the gases into the wet cleaner. In the wet cleaner, the exhaust gases are simultaneously washed and cooled. The cooled exhaust gases are further conducted, humidified by the vapours created in the washing, back into the suction duct of the diesel engine. The recirculated exhaust gas, the guantity whereof is about 20% of the whole exhaust gas volume, is mixed in the general suction air flow by means of a mixer valve and a nozzle, whereby the mixture ratio can be maintained constant irrespective of the charge and the speed of rotation.

When employing the method of the invention, the recirculation of the exhaust gases, the cooling of the recirculated exhaust gases, and the water additions into the combustion chamber, as well as the regulation of the volume of the returned gas, can thus all be combined.

Figure 2:
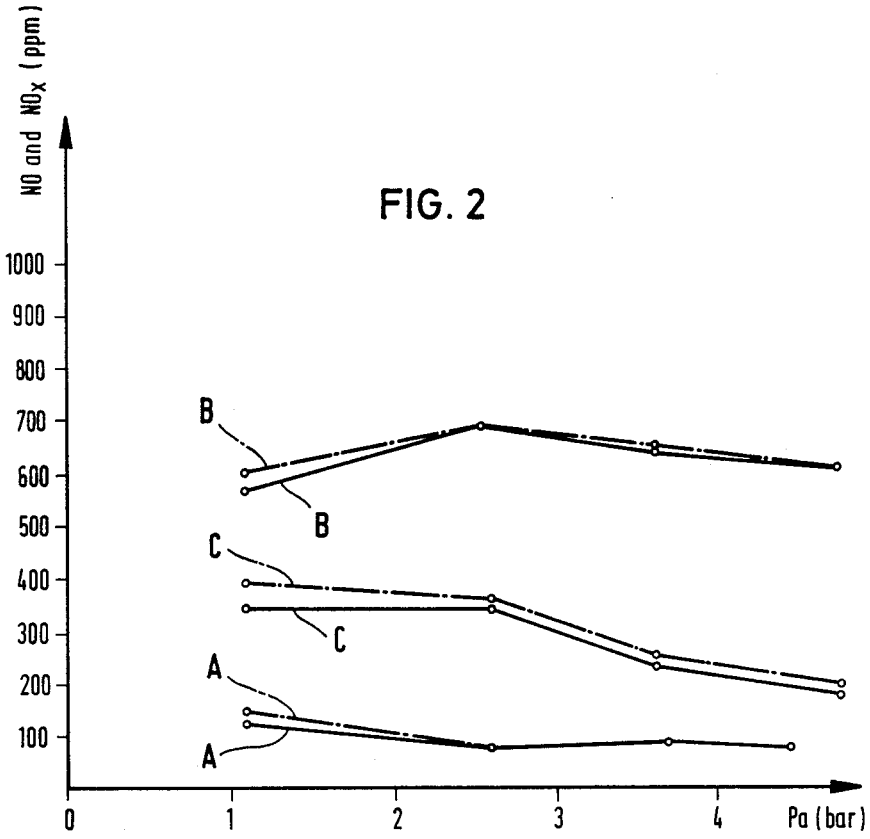

In the following the invention is explained with reference to the appended drawing, where FIG. 1 is a schematical illustration of a preferred embodiment of the invention, and FIG. 2 illustrates the superiority of the damp recirculation method of the invention, as compared to the prior art dry recirculation method.

According to FIG. 1, the exhaust gases from the diesel engine 1 are conducted, through the catalyzer 2, into the wet cleaner 3. In the wet cleaner 3, the exhaust gases are cooled and washed. The major part of the exhaust gases are discharged through the exhaust pipe 4. The damp exhaust gas to be recirculated according to the invention is conducted, through the return pipe 5, into the suction system 10 of the diesel engine. The recirculated exhaust gas supplied from the return pipe 5, which gas is humidified by the steam created in the cleaner 3, is conducted, via the recirculation valve 6, back to the recirculaiton nozzle 7. The suction air of the diesel engine, drawn in through the air purifier 8, is also conducted to the nozzle 7. The mixture of recirculated exhaust gas and pure suction air thus created in the nozzle 7 is further conducted, via the suction duct 10 of the diesel engine, into the combustion chamber 9, wherefrom the created exhaust gases are further conducted to the catalyzer 2. By means of the recirculation valve 6 and the nozzle 7, there is achieved an advantageous regulation of the volume of the recirculated exhaust gas, so that a profitable mixture ratio between the suction air and the recirculated exhaust gas is maintained irrespective of any possible changes in the charge or in the speed of rotation.

In FIG. 2, where the symbol $NO_x$ refers to the sum of the nitric oxides NO and $NO_2$, the damp recirculation of the exhaust gases according to the invention is compared to the prior art dry recircultion, when the recirculated portion is 20% of the total exhaust gas volume. The nitric oxide content curves, drawn in FIG. 2, are illustrated as a function of the mean pressure of the engine. It is apparent from FIG. 2 that while employing the method of the invention (curves A), the total amount $NO_x$ of the nitric oxides is essentially reduced compared to the so-called dry recirculation method (curves B) of the prior art. The superiority of the damp recirculation method is also obvious when comparing the content of curves A to the curves C representing such prior art method where water is conducted into the diesel engine, but the exhaust gases are not recirculated. According to curves A, the total amount $NO_x$ of the nitric oxides is reduced, and the component $NO_2$, considered to be the most dangerous among the nitric oxides, is almost completely eliminated from the exhaust gases when applying the method of the invention, while the mean pressure of the engine is increased.

What is claimed:

1. A method for reducing the nitric oxide emissions of exhaust gases from a diesel engine by additions of water into an engine combustion chamber of said diesel engine and by recirculating exhaust gases, comprising conducting exhaust gases created in the engine into a wet cleaner for washing and cooling the gases, returning washed and cooled gases from the wet cleaner to a suction system of the engine, and maintaining constant the relationship by volume between a total gas volume of the engine and the volume of recirculated exhaust gases.

2. The method of claim 1 wherein the recirculated exhaust gases contain the water additions.

3. The method of claim 1 or 2 wherein the amount of recirculated exhaust gases is about 20% of the total exhaust gas volume.

* * * * *

UNITED STATES PATENT AND TRADEMARK OFFICE

CERTIFICATE OF CORRECTION

PATENT NO. : 4,958,490

DATED : September 25, 1990

INVENTOR(S) : Harri J. Harjunpaa

It is certified that error appears in the above-identified patent and that said Letters Patent is hereby corrected as shown below:

Column 1:

line 24, "Applicatin" should read: --Application--.

line 37, "Application" should read: --Applications--.

line 58, "recurculated" should read: --recirculated--.

Column 2:

line 14, "is in no iway" should read: --is in no way--.

line 65, "recirculaiton" should read: --recirculation--.

Signed and Sealed this

Third Day of March, 1992

*Attest:*

HARRY F. MANBECK, JR.

*Attesting Officer*

*Commissioner of Patents and Trademarks*